US005838343A

United States Patent [19]

Chapin et al.

[11] Patent Number: 5,838,343

[45] Date of Patent: Nov. 17, 1998

[54] BACKUP PRINT CARTRIDGE FOR BANK OF INK-JET PRINTING CARTRIDGES

[75] Inventors: Kenneth C. Chapin; Michael A. Graziano, both of Grand Island; Henk Haan, Niagara Falls; Anthony V. Moscato, N. Tonawanda; Roger J. Rowland, Niagara Falls, all of N.Y.

[73] Assignee: Moore Business Forms, Inc., Grand Island, N.Y.

[21] Appl. No.: 440,462

[22] Filed: May 12, 1995

[51] Int. Cl.[6] ..... B41J 2/155; B41J 2/145; B41J 2/15; B41J 2/165

[52] U.S. Cl. ..... 347/22; 347/12; 347/23; 347/40; 347/42; 347/31

[58] Field of Search ..... 347/42, 22, 40, 347/12, 31, 33, 30, 23

[56] References Cited

U.S. PATENT DOCUMENTS

| | | | |
|---|---|---|---|
| 5,081,472 | 1/1992 | Fisher | 347/13 |
| 5,115,250 | 5/1992 | Harmon et al. | 347/33 |
| 5,202,702 | 4/1993 | Terasawa et al. | 347/32 |
| 5,206,666 | 4/1993 | Watanabe et al. | 347/33 |
| 5,266,974 | 11/1993 | Koitabashi et al. | 347/33 |
| 5,398,053 | 3/1995 | Hirosawa et al. | 347/42 |
| 5,428,375 | 6/1995 | Simon et al. | 347/40 |
| 5,552,811 | 9/1996 | Kurata et al. | 347/33 |

*Primary Examiner*—Benjamin R. Fuller
*Assistant Examiner*—Thien Tran
*Attorney, Agent, or Firm*—Nixon & Vanderhye, P.C.

[57] ABSTRACT

In a printer assembly having a rack of ink-jet print cartridges, a backup cartridge is moved into alignment with a cartridge to be cleaned and the backup cartridge substitutes for printing of the cartridge being cleaned until the cleaned cartridge is moved back to its printing position. The backup cartridge is then moved into alignment with another cartridge and prints for that cartridge which is then cleaned. Ink-jet print cartridges must be periodically cleaned to wipe excess ink and particles from the nozzle array on the front face of the cartridge. Cartridges are cleaned by moving them to a cleaning station that wipes clean the front face of the cartridge. To avoid interruption of printing while cartridges are being cleaned, a backup cartridge is moved into alignment and substitute prints for a cartridge to be cleaned.

11 Claims, 3 Drawing Sheets

BACKUP PRINT CARTRIDGE FOR BANK OF INK-JET PRINTING CARTRIDGES

RELATED APPLICATIONS

This application is related to commonly owned U.S. patent application Ser. No. 08/277,075, entitled "Continuous Cleaning Thread For Ink-Jet Printing Nozzle" filed by Paul Paroff on Jul. 19, 1994; and Ser. No. 08/437926 entitled "Cleaning Fluid Apparatus And Method For Continuous Printing Ink-Jet Nozzle" filed by Henk Haan et al on May 9, 1995 1994 (attny. Dkt No. 263-1241) Both of these applications are incorporated by reference.

FIELD OF THE INVENTION

The invention relates to the field of ink-jet and bubble-jet printers and, in particular, drop-on-demand jet printers.

BACKGROUND AND SUMMARY OF THE INVENTION

Drop-on-demand ink-jet and bubble-jet printers (collectively referred to as ink-jet printers) propel fine ink droplets from nozzles in a print cartridge onto a paper substrate adjacent the nozzles. Examples of these types of printers are the Cannon nozzles known as BCO1 and BCO2. By precisely controlling the trajectory and the time of ejection of the ink droplets, the ink-jet prints create sharp images on paper that are composed of dots formed from the ink droplets. To achieve precise positioning of droplets of ink on a substrate, ink-jet nozzles must have clear and clean orifices for the ink droplets to pass through as they fly from the nozzles to the paper. In a conventional drop-on-demand ink-jet print cartridge, the printing nozzles is an array of orifices arranged on a front face of the cartridge.

During printing, ink is propelled from the orifices in the nozzle array toward the paper or other substrate. The flight of the ink droplets and especially their impact on the paper surface creates a fine mist of ink that coats the surface of the nozzle. Also, during the ejection of the droplets from the nozzle array, extraneous ink is sprayed and deposited on the front face of the cartridge adjacent the orifices. This moist ink coats the front cartridge face and attracts paper fiber, dust, grit and other types of particles that can obstruct the nozzle orifices and block the ink droplets being sprayed from the nozzle. The extraneous ink can build up on the front face of the cartridge to such an extent that the ink and entrained particles block one or more orifices in the nozzle array and thereby interfere with printing. Accordingly, there is a need to regularly clean the front face and nozzle array of ink-jet print cartridges so that the nozzles remain free of excess ink and particles that will otherwise interfere with printing.

In the past, ink-jet printers have been cleaned by wiper mechanisms that clean the nozzle plates and orifices after printing has stopped. Between print jobs and when printing is stopped, the print cartridge moves away from the paper web to a cleaning station where it slides against a wiper. The wiper squeegees across the front face of cartridge to remove ink and particles from the nozzle array. Because the wiper temporarily obstructs the print nozzles, the wipers are used only when the ink-jet printer cartridge is not printing. For example, a wiper may be positioned at the far edges of a carriage path, beyond the edges of the paper web adjacent to the carriage path. An example of a traditional wiping system is disclosed in U.S. Pat. No. 5,126,765, entitled "Ink-jet Recording Apparatus Having Cleaning Means For Cleaning A Recording Head".

Traditional wipers have proven generally acceptable for desk top printing applications where each individual print job is relatively short and the times between when the cartridge print nozzles are wiped clean are relatively brief. In a typical desk-top ink-jet printer, the carriage with the ink-jet print cartridge can be shifted to a cleaning station after each print operation. In the usual desk-top application, the printing nozzles are cleaned frequently by conventional wipers and tend not to clog with particles.

With continuous web-feed printing, the print cartridges are required to print constantly for many hours. This is unlike typical desk-top printing applications in which each printing operation is conducted in a relatively short period of time. Shifting the print cartridge to a cleaning station away from the paper to be printed necessarily interrupts the printing operation of a continuous printer. While these interruptions do not substantially interfere with typical desk top print jobs, they do interfere with commercial printing of continuous webs. In this regard, conventional ink-jet print heads have been found to require cleaning for every 30 to 60 minutes of printing. Accordingly, remote cleaning stations for ink-jet printers are undesirable for commercial continuous printers because the print operation must be interrupted every one-half hour to one and one-half hour to clean the nozzles.

Moreover, high-speed, continuous ink-jet printers employ a rack of print cartridges evenly spaced across the width of a print area of a moving web. The print cartridges usually do not move back and forth across the web during printing. Instead, each cartridge remains stationary (or moves from side to side only a short distance) and printing across the width of the web is accomplished by simultaneously printing from all of the cartridge in the rack of cartridges.

A rack of print cartridges allows for faster printing and a higher web speed than is possible with printing from a single (or few) print cartridge that must move relatively-long distances across the face of the web for each line of the paper web. A disadvantage of a rack of cartridges is that each cartridge in the rack must be periodically cleaned. Conventionally, printing is stopped every 30 to 60 minutes so that each printer cartridge can be cleaned. This continual interruption in printing has proven problematic and is highly disruptive of continuous and high-speed web printing.

It is highly desirable to continue printing while the ink-jet print cartridges are being cleaned. Recently, some techniques have been developed for cleaning (at least partially) an ink-jet print cartridge while printing is on-going. An example of such a cleaning technique is disclosed in commonly-owned U.S. patent application Ser. No. 08/277,075, entitled "Continuous Cleaning Thread For Ink-Jet Printing Nozzle" and filed on Jul. 19, 1994, the disclosure of which is hereby incorporated by reference. However, techniques for cleaning an ink-jet print cartridge while the nozzles of the cartridge continue to print do not directly clean the nozzle orifices. These techniques prolong the time between thorough cleanings of the cartridge, but they do not altogether avoid the need for periodic cleaning of the nozzle orifices such as occurs when the front face of the cartridge is wiped clean. Accordingly, there is a long-felt need for an apparatus and method for thoroughly cleaning a plurality of ink-jet print cartridges while printing continues.

The current invention relates to a technique for automatically moving a backup print cartridge into alignment with a selected cartridge in a rack of cartridges activating the backup cartridge into a print mode, and inactivating and cleaning the selected cartridge. While the selected cartridge is being cleaned, the backup cartridge is printing. Once cleaned, the selected cartridge is moved back to its original position, activated for printing and the backup cartridge is inactivated. The backup cartridge can then be moved into alignment with the next selected cartridge to be cleaned or to a cleaning station for cleaning of the backup cartridge. By continuously moving the backup print cartridge into alignment with each of the print cartridges in the printing assembly rack, the backup cartridge can substitute print for each of the cartridges in the rack as they are each cleaned one-by-one. Because of the backup cartridge, printing continues while each cartridge is cleaned. Accordingly, the current invention provides a technique and apparatus for continually cleaning individual ink-jet print cartridges in a rack of cartridges while printing continues.

An object of the current invention is to clean the nozzle array of ink-jet print cartridges and prevent ink, dirt and paper particles from obstructing the orifices of the nozzle arrays in these cartridges. A further object of the invention is to extend the period of maintenance free printing for ink-jet printers and to reduce the amount of off-printing cleaning required for ink-jet printers. Moreover, another objective of the invention is to enhance the print quality of ink-jet printers by overcoming many of the problems caused by extraneous, girt and paper particles that have clogged the printing nozzles of prior ink-jet printers. These and other objectives are achieved by the invention that is shown and described in detail below.

BRIEF DESCRIPTION OF THE DRAWINGS

The invention will be explained in greater detail with reference to the drawings identified as follows.

DETAILED DESCRIPTION OF THE PREFERRED EMBODIMENT

Figure 1:
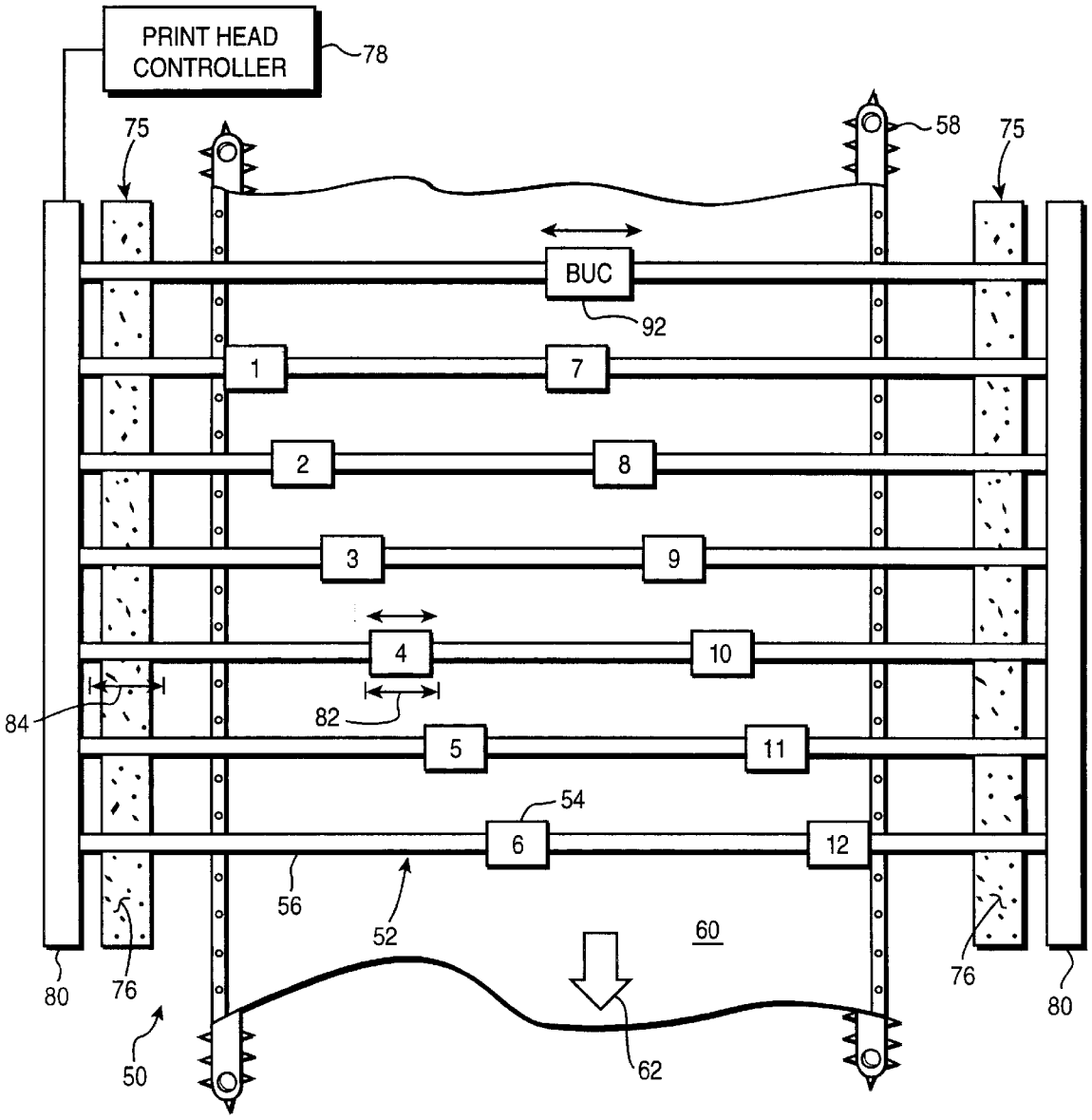
FIG. 1 is a diagrammatic view of a bank of ink-jet print cartridges, including a movable backup cartridge.

FIG. 1 shows an ink-jet printer assembly 50 comprising a rack 52 of primary ink-jet print cartridges 54 which in the disclosed embodiment includes twelve (12) cartridges (1 to 12) mounted in an abacus arrangement on several parallel rows of carriage shafts 56. Each carriage shaft supports two print cartridges, e.g., 6 and 12, and may include conventional devices to slide each cartridge to its respective end of the carriage shaft or to rotate the cartridge.

The printer assembly may also include a conventional web feed device 58, e.g., a tractor feeder, for moving a continuous web 60 in front of the printer assembly for high-speed web printing. It is common for the web speed in such printers to be 300 feet per minute and have an operating speed range of 200 to 500 web-feet per minute. In addition, these printers operate continuously and will typically print for periods as long as twelve hours without interruption.

The paper web or other substrate 60 moves parallel to the printer assembly 50 in a forward direction, as shown by directional arrow 62. The section of web to be printed is positioned directly in front of and generally parallel to the nozzle arrays of the ink-jet print cartridges 54. The printing mechanism includes conventional web handling devices to move the web at a predetermined speed, in a precisely controlled fashion and along a predetermined path. In addition, the printing mechanism may include a plane platen 63 to provide a plane surface against which the paper web slides while being printed upon. The ink-jet printer cartridge is attached to the shaft by a bracket 64 that is mounted on the shaft and is adapted to hold the cartridge. The bracket may also include cooling fins to dissipate heat from the cartridge. Similarly, a thermocouple may be attached to the root of a heat fin to sense the temperature of the cartridge. The bracket may be formed of aluminum or any other material that is suitable for securely holding the ink-jet nozzle assembly.

Each ink-jet printer cartridge includes a front face 66 adjacent and parallel to the paper web. On the front face of the cartridge, is an array of nozzle orifices 68. The front face of the cartridges may have a hydrophilic coating, e.g. Teflon, at or near the orifices to draw excess ink away from the nozzle orifices. Ink droplets 70 are propelled from these orifices towards the paper web 60 for printing. As the ink droplets impact onto the web, most of the ink remains on the web as dots 72, or other indicia. Some of the ink splatters as it hits the paper and forms an ink mist that coats the front face of the cartridge. In addition, some of the ink from the ink-jet sprays onto the sides of the orifices. Ink from the mist and spray coats the front face and nozzle array and builds in thickness as ink printing continues. The ink coating 74 on the front face of the cartridge also entrains fibers, dust and other particles that collect on the front face of the cartridge. This coating of ink, fibers and other particles must be wiped off the front face of the cartridge from time to time to ensure that the nozzle orifices do not become clogged and thereby interfere with printing. The current invention is a technique for cleaning the cartridge while performing a printing function to remove ink and particle build-up on the cartridge front face, especially around the area surrounding the nozzle orifices.

The front face of each ink-jet printer cartridge 54 is wiped clean from time to time to remove excess ink and particles. To wipe clean the front face, the cartridge is moved to a cleaning station where the front face is wiped clean. The cleaning station may be any device that cleans the front face of a print cartridge while the cartridge being cleaned is off-line, i.e., it is not in a printing position. For example, the cleaning station 75 may be strip(s) of an adsorbent material 76, such as a cloth or sponge, parallel to the paper web and set off from either or both edges of the web, as is shown in FIG. 1. The strip of adsorbent material may be attached to the frame 80 that supports the carriage shafts 56, such that the front surface of the adsorbent material is positioned to be in wiping contact with the front face 66 of each cartridge as each cartridge slides from its printing position, e.g., 82, to its cleaning position, e.g., 84.

Figure 2:
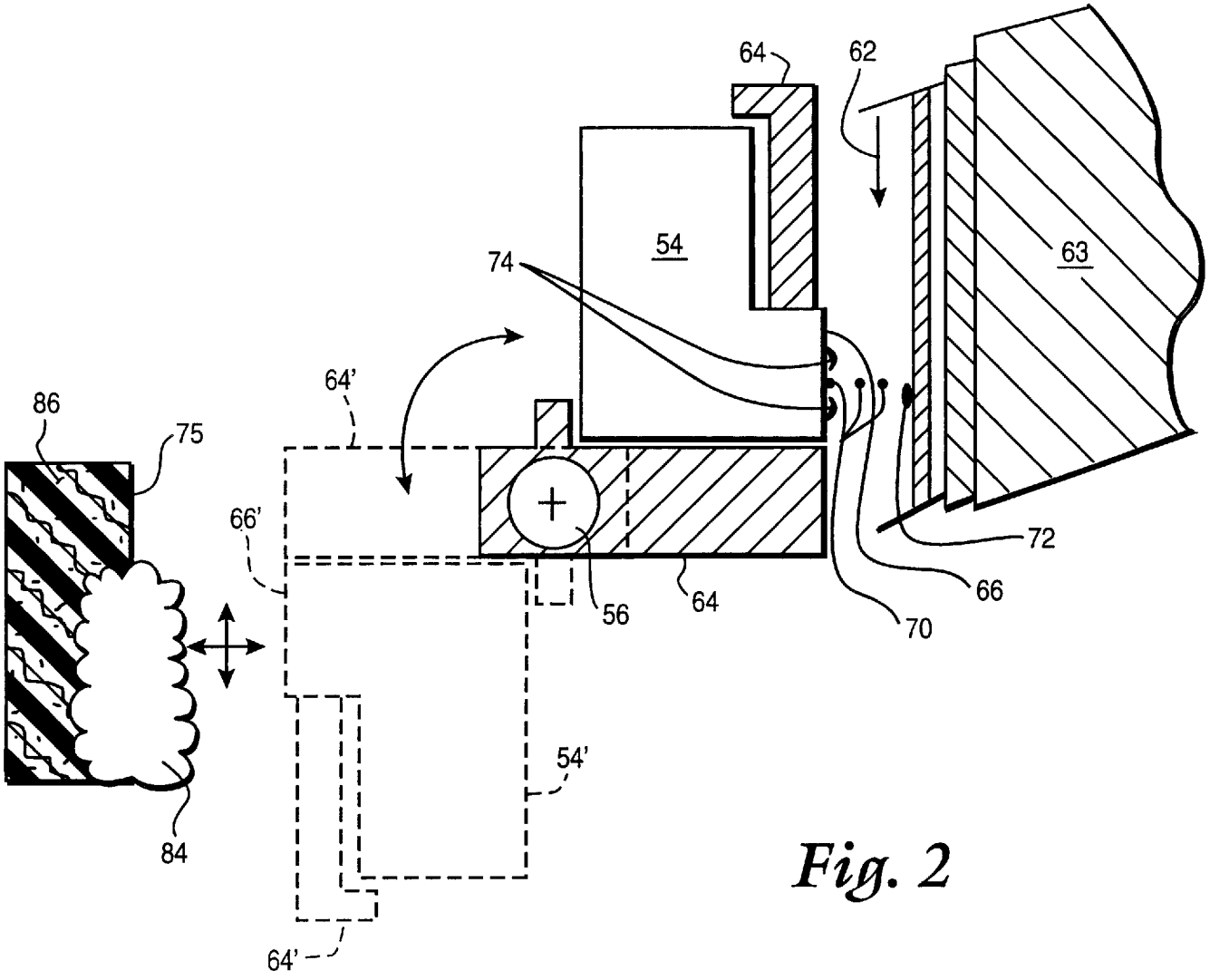
FIG. 2 is a close-up diagrammatic crosssectional view of an ink-jet print cartridge with an associated cleaning station.

Another example of a printing station 75 is shown in FIG. 2. In this second example, a cleaning station is located behind and slightly below each print cartridge 54. The bracket 64 for each cartridge is rotatably mounted on the carriage shaft 56 such that the cartridge can be rotated to the cleaning station 75. The rotational movement of the bracket 64' about the shaft causes the front face 66' of the cartridge 54' to be aligned with the cleaning station 75 that includes a pad 86 of adsorbent material and a holder 88 for the pad. The holder 88 may be moved such that the cleaning pad is in abutting contact with the front face of the print cartridge and then the pad is wiped across the face of the cartridge to clean the cartridge. Alternatively, the print cartridge may be moved such that it wipes across the adsorbent material.

The print head controller 90 is a programmable device that controls the operation of each print cartridge, including the printing of ink droplets onto the paper web and the movement of the cartridge to an off-line cleaning station. The print heads are controlled via a controller which is provided with variable or static print data through the XL Data System and raster image processor (RIP). This data is then converted via an electronic interface to change the data to the necessary print signals to initiate, continue and terminate the print cycles. The XL Data System and RIP are available from Moore Business Forms, Grand Island, N.Y. The print cartridge controller is novel in the respect that it is programmed to control the cleaning of print cartridges and the operation of a backup print cartridge (BUC) 92 while printing continues.

Figure 3:
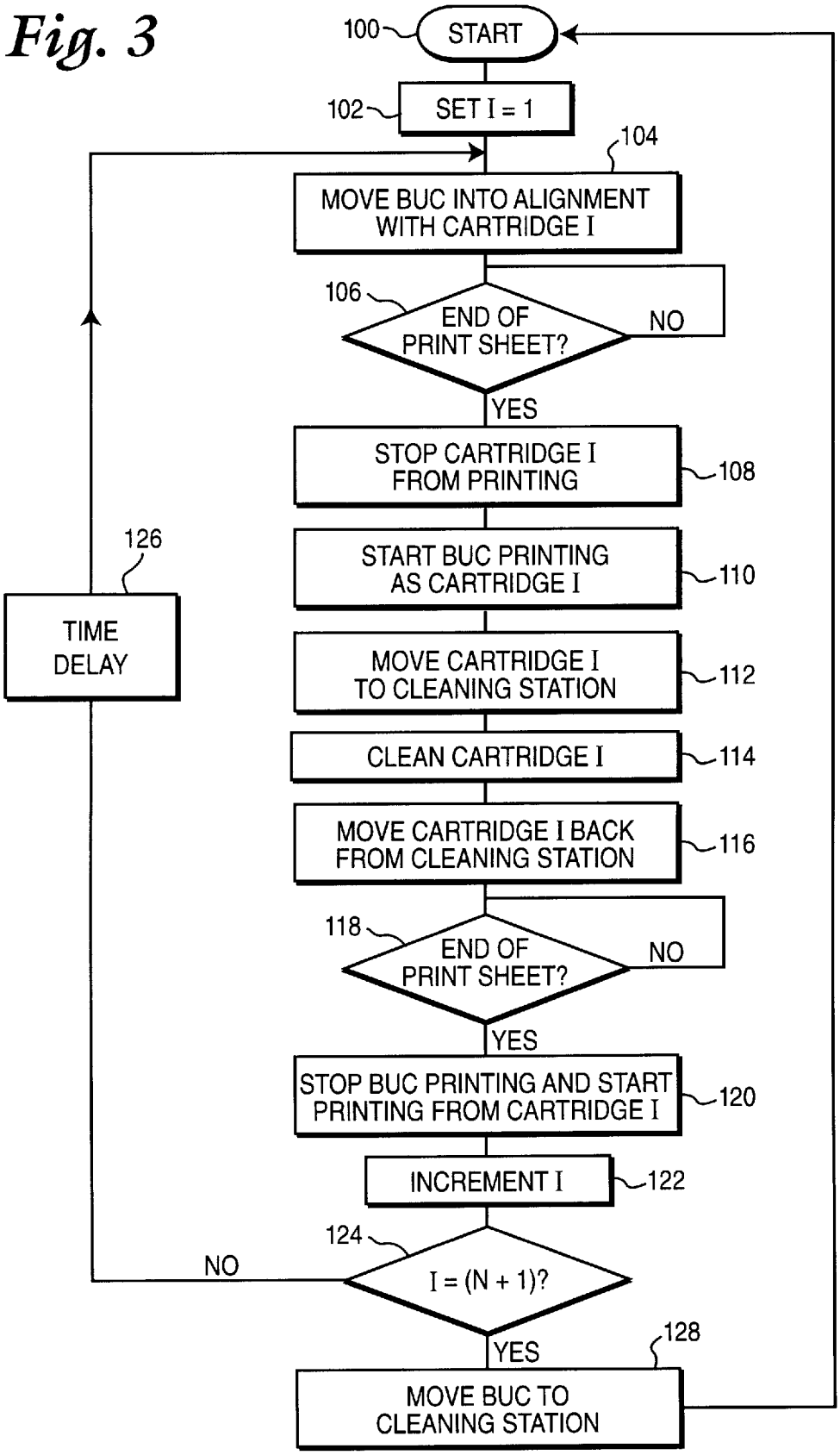
FIG. 3 is a flow chart showing the operation of the backup cartridge and the cleaning operation of cartridges.

The operation of the print cartridge controller in the regard of cleaning cartridges is shown in the flow chart of FIG. 3. The print cartridge controller can be programmed to individually move each of the primary print cartridges 54, e.g., nos. 1 to 12, to a cleaning station, such as a strip of adsorbent material 76 or cleaning pad 86. Just prior to moving the selected print cartridge to move a backup print cartridge (BUC) 80 to the position of the primary cartridge to be cleaned and activating the backup cartridge to print in substitution for the primary cartridge to be cleaned. In addition, the print cartridge controller can be programmed to periodically move the backup print cartridge to a cleaning station to be cleaned.

FIG. 3 shows one exemplary program sub-routine for controlling the cleaning operation of print cartridges. At the start, step 100, of the subroutine the printer controller 78 initiates a routine for individually cleaning each of the print cartridges, including the backup cartridge. Once the cleaning sequence has been initialized, step 102, the controller causes the backup cartridge to be moved into alignment, e.g., vertical alignment, with the first of the cartridges 54 to be cleaned, step 104. In FIG. 1, the backup cartridge is shown to be in alignment with print cartridge labeled no. 7. The controller then waits for the end of a sheet in the web, or other equivalent break in the printing operation, step 106, before stopping printing from the cartridge to be cleaned, step 108, and starting printing from the backup cartridge, step 110. In step 112, the cartridge to be cleaned is moved, e.g., slid or rotated, to a cleaning station 75 where the front face of the cartridge is wiped, step 114, to remove excess ink and particles that have built-up on the face. The cleaned cartridge is moved back into its printing position, step 116. The controller waits for an interruption in the printing, step 118, at which time it stops printing from the backup controller and starts printing again from the cleaned cartridge, step 120. The cartridge count is incremented, step 122, which indicates to the controller whether all of the primary cartridges have been cleaned, step 124. The controller repeats the steps 104 to 124 for each primary cartridge until all of the cartridges have been cleaned. There may be a programmed pause, step 126, between each cartridge cleaning procedure if, for example, the desired time period between cleanings of an individual cartridge is substantially longer than the time needed to clean all of the cartridges. The pause in step 126 between cleaning steps may be selected such that all of the cartridges, including the backup cartridge, are cleaned once every one-half to one and one-half hours, or such other time that is the normal printing period between cleanings for an individual cartridge. Once all of the primary cartridges have been cleaned, see step 124, then the backup cartridge is cleaned, step 128, before the cleaning routine returns to start again.

The invention has been described in what is considered to be the most practical and preferred embodiment. The invention is not limited to the disclosed embodiment(s), but covers various modifications and equivalent arrangements included within the spirit and scope of the appended claims.

What is claimed is:

1. An ink-jet printer assembly comprising:

a print cartridge rack including a plurality of cartridge rods spanning a web substrate:

a plurality of ink-jet print primary cartridges each slidably mounted on a one of the cartridge rods of the rack and said cartridges being arranged in an array across the web substrate, wherein each cartridge prints ink droplets onto the web substrate in conjunction with other cartridges simultaneously printing onto the substrate, and wherein each cartridge periodically moves along one of the cartridge rods from a printing position to a cleaning station during an ongoing printing operation by the assembly; and an ink-jet print backup ink cartridge mounted on a rod of said rack and adapted moves into alignment with a designated primary cartridge, wherein the backup ink cartridge prints to the web substrate in substitution for and when the designated primary cartridge moves to the cleaning station, is cleaned and returns to the printing position.

2. An ink-jet printer assembly as in claim 1 wherein said cleaning station is at least one strip of adsorbent material offset transversely from said web substrate and positioned to receive a front face of said designated primary cartridge.

3. An ink-jet printer assembly as in claim 1 wherein each of said primary cartridges slides along the one of said cartridge rods to the a cleaning position aligned with said cleaning station, where said cleaning position is transversely offset from said web.

4. An ink-jet printer assembly as in claim 1 wherein said cleaning station is positioned behind at least one of said cartridges and said at least one of said cartridges is rotatably mounted on the rack.

5. An ink-jet printer assembly comprising:

a rack of carriage shafts and a frame supporting the shafts wherein said carriage shafts are transverse and adjacent to a moving web substrate;

a plurality of ink-jet printer primary cartridges for printing on the web substrate, each primary cartridge is mounted on one of said shafts such that the plurality of primary cartridges forms an array across a width of the web substrate, and wherein each cartridge has a printing position in said array and a cleaning position;

at least one cleaning station located proximate to each cartridge when in the cleaning position, and the cleaning station being in wiping engagement with a nozzle array on a surface of each of said cartridges;

an ink-jet printer backup cartridge slidably mounted on one of said carriage shafts, and a printer controller operatively coupled to said plurality of ink-jet printer primary cartridges for individually moving the backup cartridge into alignment with a designated primary cartridge, causing the backup cartridge to print in substitution for the designated primary cartridge, and moving the designated primary cartridge from the printing position to the cleaning position while the backup cartridge and a remaining group of primary cartridges continues to print on the web substrate.

6. An ink-jet printer assembly as in claim 6 wherein the at least one cleaning station includes a strip of adsorbent material attached to the frame of the rack, perpendicular to the carriage shafts and offset from an edge of the web substrate.

7. An ink-jet printer assembly as in claim 5 further comprising a web feed means for moving the web substrate along a path adjacent the nozzle array on each of the cartridges in the rack.

8. An ink-jet printer assembly as in claim 5 wherein the at least one cleaning station is a pad of adsorbent material positioned behind each of said cartridges when in the printing position and said cartridges rotated from the printing position to the cleaning position to be in wiping contact with the pad.

9. A method for cleaning a plurality of ink-jet printer assembly having ink-jet primary cartridges mounted in a printer assembly including a rack supporting the primary cartridges and a ink-jet backup cartridge, comprising the following steps:

a. printing ink droplets on to a web substrate simultaneously from the plurality of primary cartridges;

b. moving the backup cartridge into alignment with a designated primary cartridge;

c. printing from the backup cartridge in substitution for printing from the designated primary cartridge;

d. cleaning a nozzle array on the designated primary cartridge while the backup cartridge prints in place of the designated primary cartridge;

e. moving the cleaned primary cartridge into alignment with the backup cartridge, and f. restarting printing from the designated primary cleaned cartridge and suspending printing from the backup cartridge.

10. A method for cleaning an ink-jet printing assembly as in claim 10 wherein steps b through f are repeated for each of the plurality of primary cartridges.

11. A method for cleaning an ink-jet printing assembly as in claim 9 wherein step d is accomplished by moving the designated primary cartridge to a cleaning station that wipes excess ink from the nozzle array.

* * * * *